US006461075B2

(12) United States Patent
Bickel

(10) Patent No.: US 6,461,075 B2
(45) Date of Patent: Oct. 8, 2002

(54) DEVICE FOR SECURING A HANDLE ON A TOOL

(76) Inventor: Manfred Bickel, Av. Rafael Cabrera 24-7°-D, E-35002, Las Palmas G.C. (ES)

( * ) Notice: Subject to any disclaimer, the term of this patent is extended or adjusted under 35 U.S.C. 154(b) by 65 days.

(21) Appl. No.: 09/769,698

(22) Filed: Jan. 25, 2001

(65) Prior Publication Data

US 2001/0016966 A1 Aug. 30, 2001

(30) Foreign Application Priority Data

Jan. 31, 2000 (EP) ..... 00101844

(51) Int. Cl.[7] ..... B25G 3/28; A46B 5/02

(52) U.S. Cl. ..... 403/409.1; 403/374.1; 15/145; 16/436; 16/422

(58) Field of Search ..... 403/374.1, 409.1, 403/350, 299; 16/436, 422; 15/145, 176.6, 176.1, 228; 285/214, 217, 338, 346

(56) References Cited

U.S. PATENT DOCUMENTS 2,488,056 A * 11/1949 Eisner et al. ..... 15/176.6
2,999,706 A * 9/1961 Wilcox ..... 403/409.1
3,596,946 A * 8/1971 Burton ..... 403/409.1
4,722,140 A * 2/1988 Miceli ..... 30/153
4,776,618 A * 10/1988 Barree ..... 285/341
5,161,278 A * 11/1992 Tomm ..... 15/145
6,227,744 B1 * 5/2001 Fodrocy et al. ..... 401/284
6,378,156 B2 * 4/2002 Specht ..... 15/228

* cited by examiner

*Primary Examiner*—Lynne H. Browne
*Assistant Examiner*—Kenn Thompson
(74) *Attorney, Agent, or Firm*—Sidley Austin Brown & Wood, LLP

(57) ABSTRACT

A device for securing a handle on a tool and including inner member having a first end to be fixedly connected with the handle, a second end formed as an expansion cone to be releasably connected with the tool, and an outer thread provided between the first and second end, a securing element surrounding the expansion cone and displaceable along the cone, and an adjusting sleeve surrounding the inner member, engageable in the securing element, and having an inner thread cooperating with the outer thread provided on the inner member for enabling displacement of the securing means relative to the inner member upon rotation of the adjusting sleeve, with the adjusting sleeve having, at its handle end, a thread-free cover section forming with an outer circumference of the inner member an annular clearance, which provides for securing handles having different diameters, and with the device further including drain channels communicating with the annular clearance.

12 Claims, 1 Drawing Sheet

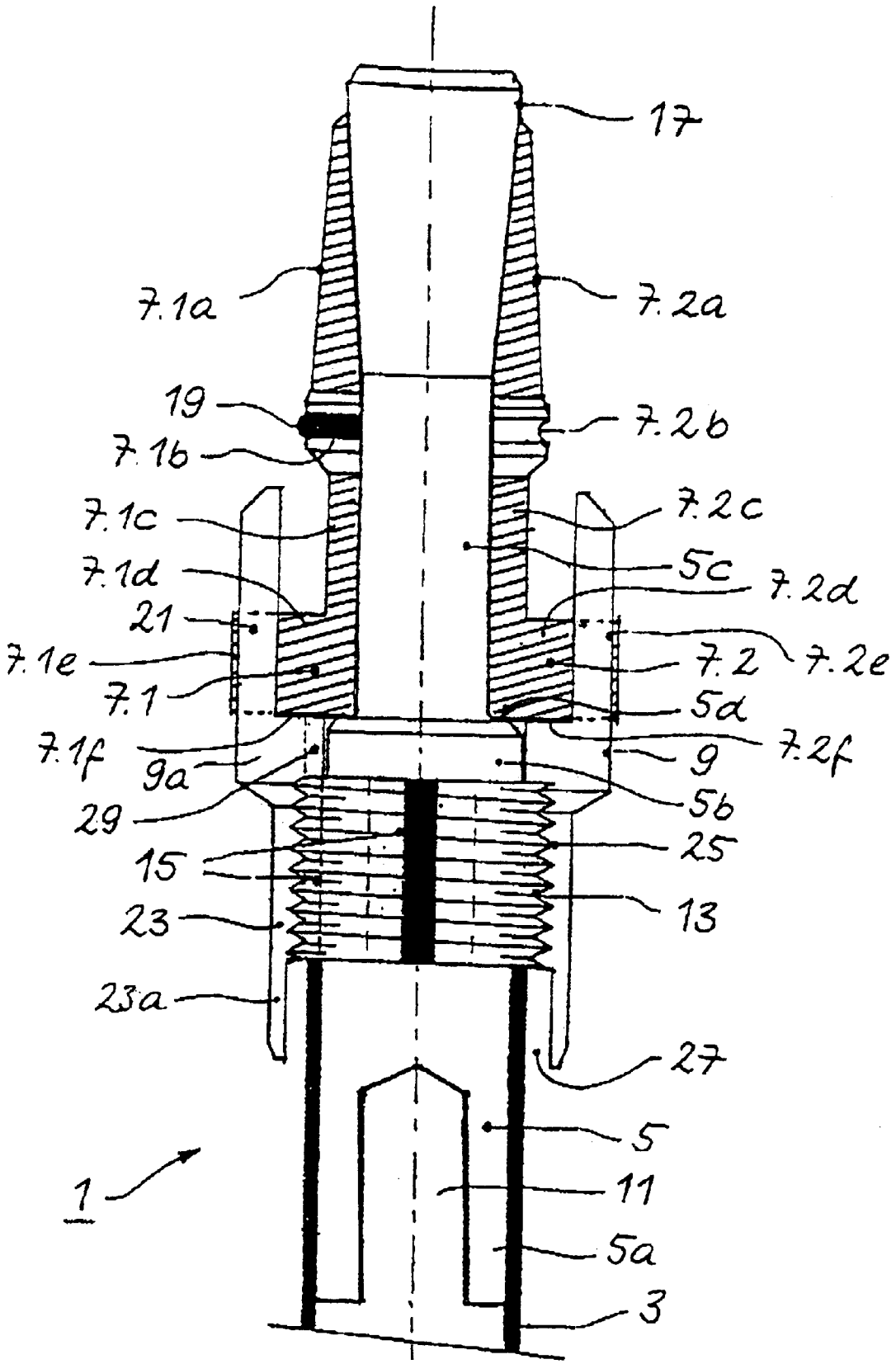
17
7.1a
7.2a
19
7.2b
7.1b
7.1c
7.2c
5c
7.1d
7.2d
21
7.1e
7.2
7.2e
7.1
5d
7.1f
9
7.2f
9a
29
5b
25
15
13
23
23a
27
5
1
11
5a
3

DEVICE FOR SECURING A HANDLE ON A TOOL

BACKGROUND OF THE INVENTION

1. Field of the Invention

The present invention relates to a device for securing a handle on a tool such as, e.g., a cleaning tool or a special tool (broom, scrubbing brush, window cleaning tool, shovel, or snow shovel), and including a substantially cylindrical inner member having a first end to be fixedly connected with the handle, a second end with an expansion cone to be releasably connected with the tool, and an outer thread provided in an intermediate region of the inner member between the first and second end; a securing element surrounding substantially the expansion cone over its substantially entire axial extent and displaceable along the inner member, the securing means expanding upon displacement over the expansion cone; and an adjusting sleeve surrounding the inner member, engageable in the securing element, and having an inner thread cooperating with the outer thread provided on the inner member for enabling displacement of the securing element relative to the inner member upon rotation of the adjusting sleeve.

2. Description of the Prior Act

Securing devices of the type described above are disclosed, e.g., in German patent No. 624,882 and German Utility Models U-76 29 578, U-76 32 002 and U-18 64 324.

A securing device disclosed in German Utility Model U-296 03 433 includes a substantially cylindrical inner member having a first end to be fixedly connected with the handle, a second end with an expansion cone to be releasably connected with the tool, and an outer thread provided in an intermediate region of the inner member between the first and second end. The expansion cone is surrounded by three securing elements held together with a rubber ring and expandable upon sliding along the expansion cone. The axial displacement of the securing element is effected by an adjusting sleeve which, on one hand, engages in the securing elements and, on the other hand, surrounds the inner member and has an inner thread engaging the outer thread of the inner member.

The securing device disclosed in U-296 03 433 presents a substantial improvement over the previously known devices, in particular, with respect to their manufacture and handling, and it has an increased service life. However, it requires further improvements with respect to its flexibility of its use, it need be more compact, and its durability need be further increased.

Accordingly, an object of the present invention is to provide a securing device of the above-mentioned type which is more flexible with regard to its use, is more compact, and has an increased service life.

SUMMARY OF THE INVENTION

These and other objects of the present invention, which will become apparent hereinafter, are achieved by providing a device of the above-described type the adjusting sleeve of which has at its handle end, a thread-free cover section forming with an outer circumference of the inner member an annular clearance providing for securing handles having different diameters; and drain channels for draining a possible accumulation of fluid in the annular clearance.

The present invention provides an adjusting sleeve which can be easily produced and handled, permits the use of the device with handles having different wall thicknesses and, if necessary made of different materials.

Providing, according to the present invention, the adjusting sleeve with a thread-free cover section having a sufficiently large diameter permits to use the device for tubular handles with different wall thicknesses due to a sufficiently large clearance formed between the cover section and the circumferential surface of the handle-side end section of the inner member. As this clearance is not completely closed after mounting of the handle, there is provided, according to the invention, drain means for draining a possible accumulation of water in the clearance between the cover section and the handle. This prevents accumulation of cleansing water or other fluid in the clearance when the device is used for securing a handle to a cleaning tool. This, in turn, prevents possible corrosion of the handle or the parts of the device when the cleaning water contains chemically-active components. As noted above, water drain channels, which are provided in the device, insure draining of the fluid from the clearance during the tool use.

In accordance with a particular simple and cost-effective embodiment of the invention, the drain channels are formed in the outer thread of the inner member or in the inner thread of the adjusting sleeve. The drain channels can also be formed in both the outer thread of the inner member and in the inner thread of the adjusting sleeve. To insure rapid draining of the clearance independent from the angular position of the handle or the securing device, there are provided at least three and, preferably, six drain channels.

According to the invention, the length of the inner thread of the adjusting sleeve and of the outer thread of the inner member preferably lies in a range between 0.5 times to 1.2 times of the thread diameter, which provides for forming of a securing device with reduced consumption of material and which occupies less space. The tests have shown that less than 10 thread turns and, in particular 8–9 turns, is sufficient for a lasting operation.

The length of the thread-free cover section, which still protects the outer thread of the inner member even in the adjusted position of the adjusting sleeve, is equal to at least half of the length of the inner and outer thread sections. The actual dimension is selected in accordance with a predetermined adjustment region of the securing means determined by the expansion cone. While according to the state of the art, the adjusting sleeve is covered, at its end remote from the handle, with a separate union sleeve, according to the present invention and independent of how the drain means is actually formed, the adjusting sleeve remains open at its end remote from the handle.

The width of the annular clearance between the cover section of the adjusting sleeve and the inner member preferably amounts to at least 10% and advantageously to from 15 to 30% of the radius of the inner member. Such clearance permits the use of the device with essentially all types of conventional handles for corresponding tools.

To provide for an increased service life and a sufficient rigidity, even when the device is used by professionals, the inner member, in particular in the region of the outer thread, is essentially formed of a solid material. In order to facilitate priming of the handle on the handle-side end of the inner member, a slot and/or a central recess is formed in this end, which slot or recess permits to compress to some extent this end.

According to the present invention, all of the parts of the device are formed of acid-resistant and base-resistant plastic materials.

The handle is connected with the inner member by gluing, welding, or injection molding.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

Single FIGURE of the drawings shows a cross-sectional view of device for securing a handle on a tool.

DETAILED DESCRIPTION OF THE PREFERRED EMBODIMENTS

The drawing FIGURE shows a securing device 1 according to the present invention for securing an aluminum tubular handle 3 on a tool (not shown) such as scrubbing brush or window cleaning head. All parts of the securing device 1 are formed of a detergent-resistant plastic material. The device 1 includes an inner part or member 5 and three securing elements which together surround the inner member 5 and of which only two securing elements 7.1 and 7.2, are shown in the drawing figure. An adjustment sleeve 9, which represents an outer part, surrounds the securing elements. The inner member 5 has, in its end region 5*a* connected with the handle 3 a large-volume slot 11 that provides for a slight compression of the end region 5*a* that enables pushing of the handle 3 onto the end region 5*a* of the inner member 5. The handle 3 can also be secured on the inner member 5 with a press fit or be glued to the end region 5*a*.

The inner member 5 has an outer (left-handed) thread 13 which is spaced from the bottom of the slot 11. The length of the thread 13 amounts to about two-thirds of the thread diameter and consists of, in the embodiment shown in the drawing, of nine turns. A plurality of axially extending water draining channels 15 are formed in the thread 13. The drain channels 15 have a substantially rectangular cross-section.

A cylindrical section 5*b*, which has substantially the same diameter as the end region 5*a*, adjoins the thread 13 at its end remote from the end region 5*a*. The section 5*b* has, at its axial end remote from the thread 13, a chamfer (not designated with a reference numeral) and is adjoined there by another cylindrical section 5*c* having a noticeably smaller diameter than the section 5*b*. Between the first and second cylindrical sections 5*b* and 5*c*, the inner member 5 has an end surface 5*d*. At its end, remote from the section 5*b*, the section 5*c* is adjoined by an expansion cone 17 which is formed as a truncated cone widening toward an end of the inner part or member 5 remote from the end region 5*a*. The widened end of the cone 17 ends with a chamfer (again, without a reference numeral). The three securing elements, of which only two elements 7.1 and 7.2 are shown in the drawings, surround the second cylindrical section 5*b* and the expansion cone 17. The securing elements occupy each an angle of 120° and adjoin each other in the tangential direction, so that the front region of the inner part 5 is completely surrounded by the securing elements. The securing elements 7.1 and 7.2 have, respectively, end sections 7.1*a* and 7.2*a* having approximately a conical cross-section and surrounding the expansion cone 17, with the wall thickness of the end sections 7.1*a* and 7.2*a* reducing to the end of the end section 7.1*a* and 7.1*b*. In the axial region of the second cylindrical section 5*c* of the inner member 5, the securing elements 7.1 and 7.2 have each an annular groove 7.1*b* and 7.2*b*, respectively having a convex annular region (not designated with a reference numeral). In a mounted condition of the securing device 1, the adjoining each other securing elements form together a circumferential groove of the annular grooves. A rubber ring 19, which is placed in the circumferential groove, holds the securing elements together, preloading them against the expansion cone 17.

In a direction toward the handle 3, cylindrical segments 7.1*c* and 7.2*c* of the securing elements 7.1 and 7.2 adjoin the annular grooves 7.1*b* and 7.2*b*, and engagement sections 7.1*d* and 7.2*d* adjoin the segments 7.1*c* and 7.2*c*. The engagement sections 7.1*d* and 7.2*d* have the largest diameter of all of the parts of the securing elements 7.1 and 7.2. The same relationships are true for the third securing element. Each of the engagement sections 7.1*d* and 7.2*d* has an axially extending groove 7.1*e* and 7.2*e*, respectively. The annular and surfaces 7.1*f* and 7.2*f* lie, in the condition shown in the drawing on the end surface 5*d* of the inner part 5 which defines a stop position of the securing means, which are formed by the securing means, which are formed by the securing elements, in the direction of the handle 3.

The adjusting sleeve 9 has three prongs 21, of which only two are shown in the drawings, projecting from a circular middle section 9*a* and which extend into grooves or recesses 7.1*e* and 7.2*e* of the engagement sections 7.1*d* and 7.2*d* of the securing elements 7.1 and 7.2. A sleeve section 23 adjoins the middle section 9*a* at its side remote from the prongs 21 and adjacent to the handle 3. A large portion of the section 23 is provided with an inner thread 25 engageable with the outer thread 13 of the inner member 5. An end region 23*a* of the sleeve section 23 adjacent to the handle 3 has no thread and has an increased inner diameter, whereby a clearance 27 is formed between the end region 23*a* and the handle 3. The middle section 9*a* of the adjusting sleeve 9 has water drain channels 29 which communicate with the clearance 27 via drain channels 15 in the outer thread 13 of the inner member 5.

For mounting of the securing device 1, the inner member 5 is fixedly connected with the handle 3. Then, the adjusting sleeve 9 is pinned over the cone 17 and the second cylindrical section 5*c* onto the inner member 5, with the inner thread 25 of the adjusting sleeve 9 being screwed over the outer thread 13 of the inner member 5. Finally, the securing elements 7.1, 7.2 and the third securing element are slided onto the cone 17, with the prongs 21 of the adjusting sleeve 9 extending through the grooves or recesses 7.1*e* and 7.2*e*, and with placing the rubber ring 19 in the circumferential groove formed by annular grooves 7.1*b* and 7.2*b*, whereby the securing elements become fixedly attached to the inner member 5.

For securing the handle 3 on a tool, the securing device 1 is inserted in a bore of a tool, which is provided for insertion of a handle, with its section remote from the handle, namely, with sections 7.1*a* and 7.1*b*. Then, the adjusting sleeve 9 is rotated from its stop position relative to the inner member 5, with the inner thread 25 being displaced over the outer thread 13 of the inner member 5, so that the adjusting sleeve 9 is displaced away from the handle 3, together with the securing elements 7.1 and 7.2. At that, the end sections 7.1*a* and 7.1*b* are displaced relative to the cone 17, expanding outwardly against the holding forces applied by the rubber ring 19. The adjusting sleeve 9 is rotated until the expandable end sections 7.1*a* and 7.1*b* engage the inner wall of the tool bore with a press fit, whereby the handle 3 becomes secured to a tool. The relatively small pitch of the threads 13, 25 provides for a large force path and, therefore, enables to secure the device in the tool with application of a small force.

The end region 23*a* of the sleeve section 23 of the adjusting sleeve 9 protects the outer thread 13 of the inner member 5 from a damage, when the handle is used with a cleaning too, even when the adjusting sleeve 9 is displaced over the inner member 5.

The end region 23*a* has an inner diameter such that the clearance 27 provides for use of handles having different wall thickness. When the handle 3, together with the securing device 1 and the rinsing tool, are submerged into a container with cleaning water or any other cleaning fluid, the cleaning water or other fluid, which is accumulated in the clearance 27, is rapidly drained through the water drain channels 15, 29, the annular clearance formed between the end surface 5*d* of the inner member 5 and the end surfaces 7.1*f* and 7.2*f* and the grooves 7.1*e* and 7.2*e* of the securing elements 7.1 and 7.2. This prevents any accumulation of the cleaning fluid in the clearance 27 and which can adversely affect the durability of the handle 3 or (when chemically aggressive components are used) damage the outer surfaces of the components of the securing device.

The present invention is not limited to the described embodiment and many derivations therefrom are possible, in particular, to accommodate different handles. The components of the device, in particular the securing elements or the prongs of the adjusting sleeve, can have different shapes.

Providing of axially and/or tangentially extending recesses in the end of the inner member adjacent to the handle insures a reliable and, at the same time, simple connection of the inner member with the handle, e.g., by press fit or by injection molding.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A device for securing a handle on a tool, comprising:

A substantially cylindrical inner member having a first end to be fixedly connected with the handle, a second end with an expansion cone to be releasably connected with the tool, and an outer thread provided in an intermediate region of the inner member between the first and second end;

securing means surrounding substantially the expansion cone over substantially entire axial extension thereof and displaceable along the inner member, the securing means expanding upon displacement over the expansion cone;

an adjusting sleeve surrounding the inner member, engageable in the securing means, and having an inner thread cooperating with the outer thread provided on the inner member for enabling displacement of the securing means relative to the inner member upon rotation of the adjusting sleeve, the adjusting sleeve having, at a handle end thereof, a thread-free cover section forming with an outer circumference of the inner member an annular clearance providing for securing handles having different diameters; and drain means for draining a possible accumulation of fluid in the annular clearance.

2. A device as set forth in claim 1, wherein the drain means comprises substantially axially extending drain channels formed in an at least one of the outer thread of the inner member and the adjusting sleeve.

3. A device as set forth in claim 2, wherein the drain means comprises at least three drain channels.

4. A device as set forth in claim 3, wherein the drain means comprises six drain channel.

5. A device as set forth in claim 1, wherein the inner and outer threads have a length amounting to from about 0.5 to about 1.2 of the thread diameter.

6. A device as set forth in claim 1, wherein the thread-free cover section has a length equal to at least half of a length of thread sections of the adjusting sleeve and the inner member.

7. A device as set forth in claim 1, wherein the annular clearance has a width amounting to at least 10% of a radius of the inner member.

8. A device as set forth in claim 7, wherein the annular clearance has a width from about 15% to about 30% of the radius of the inner member.

9. A device as set forth in claim 1, wherein the inner member 5 is substantially solid, and wherein the first end has one of a slot and a central opening to facilitate pinning of a tubular handle thereon.

10. A device as set forth in claim 1, wherein the first end of the inner member has at least one of axial and tangential recesses provided in an outer surface thereof to facilitate pinning of a tubular handle thereon.

11. A device as set forth in claim 1, wherein all of the parts of the device are formed of an acid-resistant and base-resistant plastic material.

12. A device as set forth in claim 1, wherein the handle is fixedly connectable with the device by one of gluing, welding, and injection molding.

* * * * *